United States Patent [19]

Allen

[11] Patent Number: 4,766,755

[45] Date of Patent: Aug. 30, 1988

[54] PLUNGER-TYPE PAINT ROLLER CLEANING DEVICE

[76] Inventor: Dixon L. Allen, 58 N. 300 West, Smithfield, Cache County, Utah 84335

[21] Appl. No.: 95,763

[22] Filed: Sep. 14, 1987

[51] Int. Cl.[4] ..... B08B 3/08

[52] U.S. Cl. ..... 68/213; 134/136; 134/184; 134/192; 134/197

[58] Field of Search ..... 69/213; 134/136, 184, 134/192, 195, 196, 197

[56] References Cited

U.S. PATENT DOCUMENTS

| | | | |
|---|---|---|---|
| 686,450 | 11/1901 | Hawkes | 134/196 X |
| 973,212 | 10/1910 | Richardson | 134/196 |
| 1,387,776 | 8/1921 | Henning | 68/213 |
| 1,421,971 | 7/1922 | McCarty | 134/197 |
| 1,833,515 | 11/1931 | Budde | 134/197 |
| 2,634,738 | 4/1953 | Fuller et al. | 134/196 X |
| 3,139,097 | 6/1964 | Hungerford et al. | 134/197 X |

*Primary Examiner*—Harvey C. Hornsby
*Assistant Examiner*—Frankie L. Stinson
*Attorney, Agent, or Firm*—M. Ralph Shaffer

[57] ABSTRACT

A plunger-type paint roller cleaning device wherein such device is suitably constructed for forcing a solvent longitudinally and peripherally through the nap of a wet, previously-used paint roller. In one embodiment a one-way valve is employed in conjunction with a container suitably designed to receive a paint roller. The plunger of the invention serves to draw external solvent fluid inwardly within the container, whereas a reverse action of the plunger forces the charge of solvent so drawn in to proceed longitudinally and peripherally through the roller nap, such solvent thereby carrying wet paint or other painting medium from the nap for exit from the container. In another embodiment the container receives the roller and then is filled with a charge of solvent, the container later to be closed. The plunger employed swishes the solvent back and forth longitudinally and peripherally through the nap of a roller to be cleaned; subsequently, a portion of the container of the device is removed so that the charge of now paint-laden solvent can be removed. Open-ended cylinders are or may be used for constricting the space between the nap of the roller and exterior structure and also for supplying a smooth cylinder wall for the piston of the plunger.

13 Claims, 1 Drawing Sheet

PLUNGER-TYPE PAINT ROLLER CLEANING DEVICE

FIELD OF INVENTION

The present invention relates to cleaning equipment for paint rollers and, more particularly, to a new and improved plunger-type paint roller cleaning device which is uniquely suited by its design to clean in an advantageous manner paint rollers that are wet from immediate prior use.

BACKGROUND OF INVENTION AND BRIEF DESCRIPTION OF PRIOR ART

For artisans, professional painters, and do-it-yourself property owners or property managers, there is the ever present problem of keeping up with refurbishing chores in connection with painted or otherwise finished surfaces i.e. walls, ceilings, and so forth, or of simply finishing new walls and the like. The term "paint" in "paint roller" as used herein refers to any type of liquid, be the same an enamel paint, a latex-type paint, stains, and so forth, in other words, any type of liquid that is or can be used by a roller for application of the same to a surface to be finished.

Commonly, paint rollers include an inner tube and an outer nap secured to such tube by an appropriate adhesive or by other means. The nap may be a carpet-like material, can be tufted, fibrous, or form any type of outer covering that is suitable to carry and apply paint or other finishing materials. The usual paint applicator includes a revolvable cylinder member and a handle secured thereto, the revolvable cylinder member being inserted in the inner tube of the paint roller for rotatable advance of the latter over a wall or other surface to be finished. There are several procedures extent for cleaning the roller once the same has been used. A common step is to remove the paint roller from the applicator and either dip the same in a pail of solvent or other cleaning medium, swishing the same about until the nap is essentially free of the paint used. Familiar to householders is the chore of hosing off the paint roller and shaking the same out over an unused yard area; frequently the hand must be used to "twist out" the solvent carrying paint roller so that the same is freed of the paint and allowed to dry. This is a somewhat messy operation and, furthermore, the roller is not likely to become very clean.

Another approach is of course to discard the paint roller and buy a new one. This is expensive, particularly for high-quality rollers with fluffy naps that are used for applying various textures to walls and ceilings.

While closable storage devices are known, i.e. those suitable for storing a wet roller for a period of time against immediate dry-out by ambient air, no devices are known, nor is there acquaintance with any patent literature, teaching a method and structure for cleaning paint rollers by employment of a plunger device.

BRIEF DESCRIPTION OF PRESENT INVENTION

A fundamental inventive concept herein resides in the provision of a paint roller receptacle or container. The receptacle may be thought of as comprising a container and a removable portion sometimes comprising a cap which is threaded to or otherwise releasable secured to such container. In one form of the invention the receptacle has a one-way inlet valve and also a plunger, the latter comprising a handle, a piston, and an actuating rod or shaft disposed between and secured to the handle and piston. A paint roller to be cleaned is inserted in the receptacle, the latter is closed by the cap, and the plunger is used, in one embodiment of the invention, to draw a charge of solvent or other paint carrying vehicle inwardly within the container and also within the roller disposed therein. Reverse actuation of the plunger provided will advance the fluid over the end of the paint roller and longitudinally and peripherally through the nap of the roller. Once fluid proceeds through the nap, the same advances to one or more outlet ports of the receptacle.

Hollow tubes or cylinders, open-ended at both ends, may be employed to constrict the nap space within the container so that the solvent will be constrained to flow longitudinally through the nap and not essentially beyond the periphery thereof, to insure the nap cleaning function. A cylinder can likewise be employed to reduce the diameter of the inner tube of the roller so as to provide a smooth surface for the piston of the plunger.

In another embodiment of the invention the device is constructed for opening to receive an inner charge of solvent material. The receptacle is subsequently closed and the plunger provided is used to swish the solvent back and forth through the nap portion of the roller; after cleaning the receptacle is opened to discharge the now paint-ladened solvent.

The term "solvent" is used herein will comprise any one of a number of solutions or media for removing paint, stain, and the like from paint rollers. Thus, solvent will include the usual paint thinner, turpentine, mineral spirits, water, or other suitable cleaning agent.

OBJECTS

Accordingly, a principal of the present invention is to provide a new and improved plunger-type paint roller cleaning device.

A further object is to provide a paint roller cleaning device of the type described wherein the same includes one-way valve means for permitting the drawing in of a charge of solvent, for paint roller cleaning purposes, and also for allowing such solvent to be urged through the tufted portion of a paint roller enclosed in the device.

A further object is to provide one or more cylinders in a paint roller cleaning device wherein such cylinders may be used either to provide a suitable plunger-piston surface for a plunger utilized in the design of the device and/or to constrict the spacing about the nap of the roller to be cleaned so that solvent can be urged directly through the tufted portion or nap of the roller.

A further object is to provide a plunger-type roller cleaning device wherein the same as a removable portion for permitting a charge of solvent to be introduced within such a device; subsequently the removable portion or cap of the device is replaced so that the solvent may be swished back and forth through the nap of a roller prior to discharge of the paint-ladened solvent of the device.

The features of the present invention which are believed to be novel are set forth with particularity in the appended claims. The present invention, both as to its organization and manner of operation, together with further objects and advantages thereof, may be best understood by reference to the following description, taken in conjunction with the accompanying drawings in which:

DETAILED DESCRIPTION OF PREFERRED EMBODIMENTS

Figure 1:
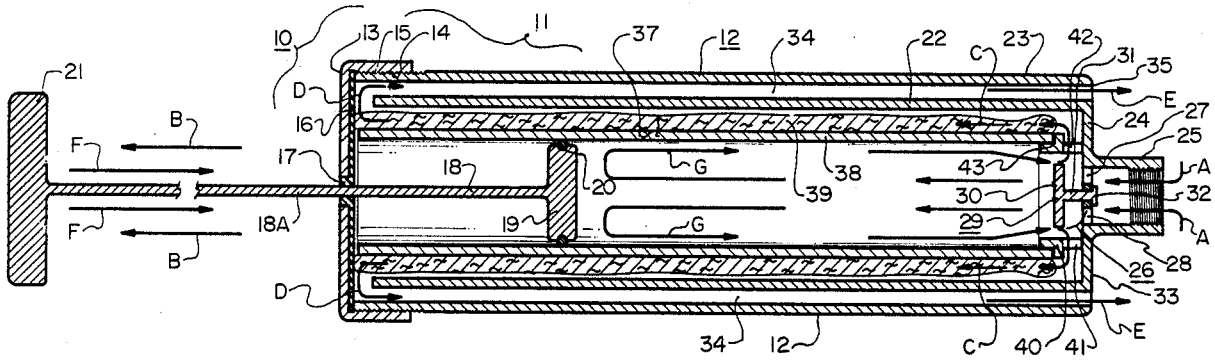
FIG. 1 is a longitudinal section of a plunger-type paint roller cleaning device according to one form of the invention, the device showing a paint roller to be cleaned as being contained therein.

In FIG. 1 the plunger-type paint roller cleaning device 10 is shown to comprise a receptacle 11 provided with container 12 and cap 13. Container 12 and cap 13 maybe cooperatively threaded at 14 and 15 to provide a threaded connection thereat. While sometimes not required, nonetheless a gasket 16 may be disposed between the cap and the left end of container 12. Packing gland 17 interiorly receives a shaft or piston rod 18 provided with piston 19. The latter includes an O-ring seal 20 in a conventional manner. Affixed to the opposite extremity of piston rod 18 is handle 21. Container 12 may include inner and outer cylindrical walls 22 and 23, respectively, which are made integral with base 24 that terminates in an inlet port 25. Operatively associated with the inlet port is a one-way valve 26 having inlet apertures 27 and 28 and a valve gate member 29 including valve gate 30 and stem 31 terminating in stop button 32. When the valve is urged to the left under fluid pressure, then liquid will enter apertures 27 and 28, the leftward progression of the valve gate being determined by the abutment of the stop button 32 against outer surface 33 of base 24. Further operation of the device will be described hereinafter. At this point it is to be noted that there is passageway 34 disposed between the inner and outer cylinders 22 and 23, which passageway leads to outlet ports 35 and 36. The inner cylinder 22 forms a space 37 of which base is cylindrical and receives a prior-used wet paint roller, the latter having an inner tube 38 provided with an outer nap 39 secured thereto an adhesive or other means. The paint roller of course is conventional, and many designs are extant in the market place. Annular seat member 40 is secured to base 24 and is provided with conducting passageways 41 and 42. These will conduct incoming fluid in a manner hereinafter pointed out. The seat may have a peripheral shoulder 43 which abuts the inner tube or cylinder of the paint roller.

In operation as to the structure of FIG. 1, the left cap 13 with this plunger 18A as above described is withdrawn from assembly with container 12. Subsequently the wet paint roller is inserted into the container to abut against the seat at shoulder 43. At this point the cap is replaced with its plunger so that the plunger rides along the inner wall of the tube of the paint roller. Gasket 16 will press against the outermost end of the container or container cylinder and the cap will be securely threaded down onto the outer threaded portion of container 12 in the manner seen in FIG. 1. At this point liquid is drawn into the inlet port as indicated by arrows A. The inlet port shown may be connected to a hose having a threaded male fitting; optionally, the same may simply be inserted into a pool of solvent liquid. In any event, a solvent such as paint thinner, turpentine, water, mineral spirits, or other suitable media will be present to the port for drawing into the container as the plunger 18A is advanced in the direction of arrows B. This draws fluid into the container and the pressure lifts or moves to the left the valve gate 30 so that liquid proceeds through apertures 27 and 28 and also through apertures 41 and 42, whereby to proceed along arrows C peripherally, or centrally and longitudinally through the nap of the roller as indicated by arrows C. The solvent thus picks up paint as it traverses longitudinally through the nap so as to exit at arrows D and proceed along the outermost path via arrows E to outlet ports 35 and 36. It is to be noted that leftward manual actuation of the plunger draws fluid into the container within the interior of the paint roller, whereas movement in the opposite direction, i.e. in the direction of arrows F in FIG. 1, will cause a return movement of the fluid along arrows G to proceed to the right and thence through apertures 41 and 42 and subsequently longitudinally and circumferentially through the nap of the roller. During the return movement of the plunger as in the directions of arrows F, the one-way valve will close, thereby preventing return flow through the inlet port at 25. Rather, the liquid is shuned through the apertures 41 and 42 to proceed through the roller nap as above specified.

Figure 2:
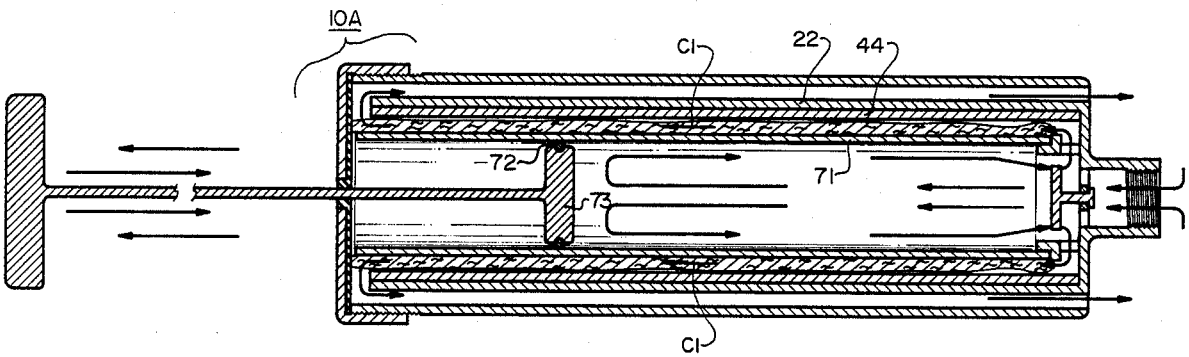
FIG. 2 the cylinder to FIG. 1 but illustrate another embodiment of the invention wherein a spacer cylinder is disposed over the outer nap of the contained paint roller this for constraining solvent through the nap of the material in the direction shown by the arrows, this for the purpose of cleaning such nap.

In FIG. 2 illustrates the device 10A similar to device 10 in FIG. 1 but wherein, this time, a additional cylinder 44 is included in the structure. This take the form of an adapter cylinder 44 which is used for slightly undersized paint rollers wherein the space between cylinder 22 and the exterior peripheral surface of the nap must be filled in to insure that fluid flow will be directed through the nap material and not exterior thereto, as the same proceeds in the direction C1 in FIG. 2. For paint rollers that are slightly undersized relative to diameter or circumferential dimension, the same paint roller cleaner device and enclosure thereof may be employed, this by simply including the adapter cylinder 44 to fill up the space between the reduced circumference of the paint roller and the cylinder 22.

In other regards the device, as to structure an operation, will remain the same.

Figure 3:
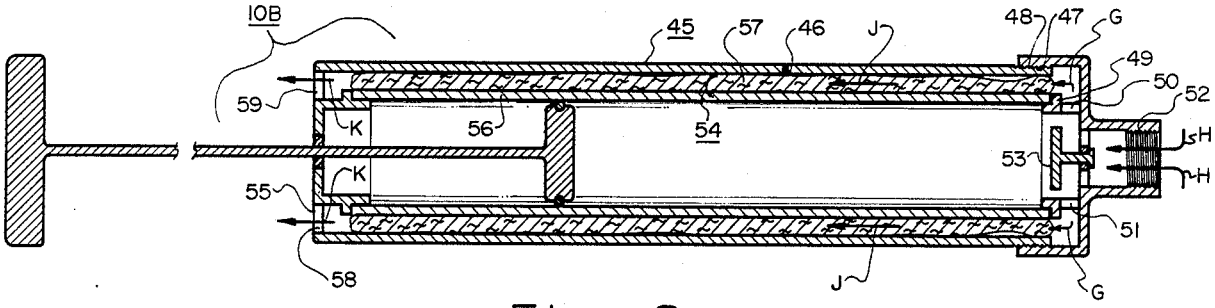
FIG. 3 is an alternate form of the invention illustrating an opposite type of fluid flow within the cleaning device so that paint-laden solvent will be discharged from the device at an end opposite to that shown in FIGS. 1 and 2.

In FIG. 3 the device 10B includes a receptacle 45 comprised of container 46 and cap 47 threaded thereon on 48 in a manner similar shown at the left-hand portion of FIG. 1. Circumferential seat 49 is included, similarly to the structure shown the the right of FIG. 1, and includes apertures 50 and 51 which are liquid passageways, and include the outlet port 52 and valve 53. The one-way valve structure will be similar to that seen in FIG. 1. A paint roller 54 is enclosed within the device after use and the cap replaced, the same as in FIG. 1. A seat 55 may be provided to the left section of the container such that the inner tube 56 of paint roller 54 may be securely seated therein, relative to the seats, at opposite ends of the tube. Accordingly, the nap 57 remains stationary and is suitable to receive solvent fluid-flow there through in the direction of arrows G.

In operation, in FIG. 3 the solvent liquid is drawn inwardly in the direction of arrows H by the suction action of the plunger in moving to the left. When the plunger is returned to the right the valve 53 closes and fluid is forced through apertures 50 and 51 to proceed through the nap of the roller in the direction of arrows J, ultimately to proceed out exhaust apertures 58 and 59 in the direction of arrows K. Thus, in the embodiment in FIG. 3, there is disclosed a structure whereby the plunger may be employed not only to draw fluid inwardly, but also to expel the same outwardly through the roller nap, to and through ports arranged at that end of the device which is remote from the inlet port thereof.

Figure 4:
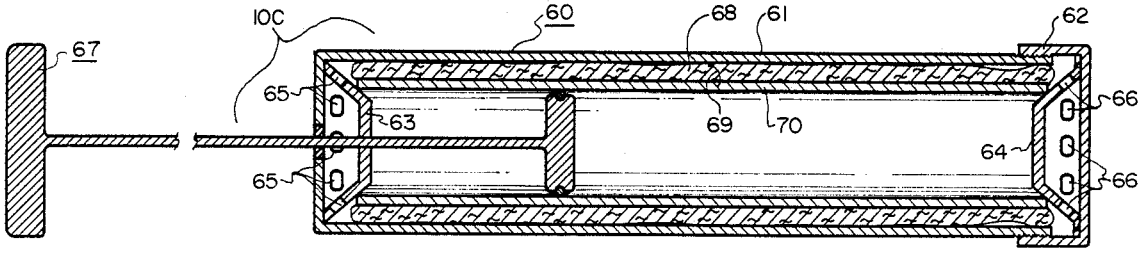
FIG. 4 illustrates an alternate form of the invention, is in longitudinal cross-section, and illustrates a paint-roller cleaning device wherein the same has a removable end cap, the latter being removed to permit a charge of solvent to be introduced into the paint roller preparatory to cap closure and the swishing of such solvent back and forth through the nap material by means of plunger actuation for cleaning the nap of the roller.

FIG. 4 illustates a further form of the invention wherein the device 10C comprises a receptacle 60 provided with container 61 and threaded cap 62. This time there will be conical seats 63 and 64 disposed at the opposite ends of the structure as shown, which a conical seats include a plurality of respective passageways 65 and 66. In operation the device is formed are in the manner indicated, the wet paint roller is inserted, and cap 62 is threaded onto container 61. Replacement of the cap will occur only after the unit has been filled with a charge of solvent material such as mineral spirits, turpentine, and so forth. During the charging process relative to the solvent, plunger 67, of a form similar to that seen in FIG. 1, will be drawn completely to the left. After the solvent has been introduced into the container, then the cap 62 is returned to its threaded position and the device is ready for actuation. Accordingly, the reciprocating movement, first to the right, of plunger 67, will produce a swishing, back-and-forth, of solvent fluid through the nap 68 of paint roller 69 which also includes the inner tube or integral cylinder 70 thereof. Thus, the reversed movement of the plunger will produce a succession of reverse-movements of the solvent through the nap in opposite directions so that the nap is clean; subsequent to this reciprocation of the plunger 67, the cap will be unthreaded at 62 and the liquid contents discharged. Subsequently the roller may be removed. For convenience of manufacturer the conical seats at opposite ends of the container may be either secured in place or may be made releasable as the case may be.

What is provided therefore is a plunger-type of paint roller cleaning device wherein the plunger is useful in forcing a suitable solvent through the nap of the paint roller so as to remove contents therein. One or more auxiliary cylinders or tubes may be provided to accommodate smaller sized rollers relative to their transverse cross-section or to align the inner portion of the inner tube of the paint roller for smooth piston advance along the inner surface thereof. In this latter regard the auxiliary cylinder 71 is seen implaced; the same may be made of plastic or metal so as to accommodate the sliding action of O-ring seal 72, of piston 73, without chancing a wearing out of the seal through contact thereof with the rough surface, often present, of simply the integral inner tube of the paint roller.

This invention has been described in its presently contemplated best mode, and it is clear that it is susceptible to numerous modifications, modes and embodiments within the ability of those skilled in the are and without the exercise of the inventive faculty. Accordingly, the scope of this invention is defined by the scope of the following claims:

What is claimed is:

1. A plunger-type paint cleaner device including, in combination, an elongate container having a longitudinal axis and an open end; a cap releasably secured to said container over said open end; a hollow paint roller to be cleansed axially disposed within said container, said paint roller comprising a hollow tube and an applicator nap secured peripherally thereto; a plunger comprising a piston operably disposed within and dimensioned to peripherally engage the interior of said paint roller, a shaft secured to said piston and journaled for axial movement to one of said container and said cap, and a handle secured to said shaft and disposed outside of said container, said container being constructed for receiving a charge of external liquid solvent working with said piston and which, when urged by said piston, passes axially and longitudinally through said nap of said roller to clean the same.

2. The device of claim 1 wherein said piston is provided with a peripheral seal.

3. The device of claim 1 wherein the combination of said cap and said container is provided with an inlet port having a one-way valve for admitting solvent within said container but preventing solvent exit through said one-way valve.

4. The structure of claim 1 wherein said container is provided with a positioned spacer sleeve surrounding and peripherally disposed proximate said nap.

5. The structure of claim 1 wherein said cap is provided with liquid exhaust aperture means.

6. The structure of claim 1 wherein said container is provided with liquid exhaust aperture means.

7. The structure of of claim 1 wherein said plunger is constructed with said container to enable said plunger, through reciprocating movement, to swish exterally-supplied solvent reciprocatingly through said nap preparatory to removal of such solvent through removal of said cap.

8. A plunger-type cleaner device including, in combination, an elongate container having a longitudinal axis and an open end; a cap releasably secured to said container over said open end; a hollow paint roller to be cleansed axially disposed within said container, said paint roller comprising a hollow tube and an applicator nap secured peripherally thereto; a plunger comprising a piston operably disposed within said paint roller, a shaft secured to said piston and journaled for axial movement to one of said container and said cap, and a handle secured to said shaft and disposed outside of said container, said container being constructed for receiving a charge of external liquid solvent working with said piston and which, when urged by said piston, passes axially and longitudinally through said nap of said roller to clean the same, and wherein said paint roller is provided with a tube member pressed into said paint roller and coacting as a cylinder with said piston.

9. A plunger-type paint cleaner device including, in combination, an elongate container having a longitudinal axis and an open end; a cap releasably secured to said container over said open end; a hollow paint roller to be cleansed axially disposed within said container, said paint roller comprising a hollow tube and an applicator nap secured peripherally thereto; a plunger comprising a piston operably disposed within and dimensioned to peripherally engage the interior of said paint roller, a shaft secured to said piston and journaled for axial movement to one of said container and said cap, and a handle secured to said shaft and disposed outside of said container, said container being constructed for receiving a charge of external liquid solvent working with said piston and which, when urged by said piston, passes axially and longitudinally through said nap of said roller to clean the same and, wherein said container is provided with a cylindrical extension for forming, with said container, a solvent exit path, said cylindrical extension cooperating with said nap whereby to constrain solvent liquid flow circularly and longitudinally through said nap.

10. A plunger-type paint roller cleaning device including, in combination, an elongated container having a closed end and an open end; a cap removably secured to said open end; a plunger passing through one of said ends and having piston means for reciprocatingly operating within and dimensioned to peripherally engage the interior of an exteriorly supplied hollow paint roller, having an interior tube and an applicator nap peripherally secured thereto, when the latter is temporarily placed within said container, the combination of said container and said cap including structure for constraining solvent flow, when external solvent is supplied said container, through said nap longitudinally and circularly therethrough, preparatory to paint-charged solvent exit from said container; and means for discharging said solvent from said container.

11. A plunger-type paint roller cleaning device including, in combination, an elongated container having a closed end and an open end; a cap removably secured to said open end; a plunger passing through one of said ends and having piston means for reciprocatingly operating within and dimensioned to peripherally engage the interior of an exteriorly supplied hollow paint roller, having an interior tube and an applicator nap peripherally secured thereto, when the latter is temporarily placed within said container, the combination of said container and said cap including structure for constraining solvent flow, when external solvent is supplied said container, through said nap longitudinally and circularly therethrough, preparatory to paint-charged solvent exit from said container; and means for discharging said solvent from said container and, wherein the combination of said cap and said container is provided with a solvent inlet port having a one-way valve.

12. A plunger-type roller cleaning device including, in combination, an elongated container having a closed end and an open end; a cap removably secured to said open end; a plunger passing through one of said ends and having piston means for reciprocatingly operating within an exteriorly supplied hollow paint roller, having an interior tube and an applicator nap peripherally secured thereto, when the latter is temporarily placed within said container, the combination of said container and said cap including structure for constraining solvent flow, when external solvent is supplied said container, through said nap longitudinally and circularly therethrough, preparatory to paint-charged solvent exit from said container; and means for discharging said solvent from said container; and where in the combination of said cap and said container is provided with plural seal means for accommodating the seating of opposite ends of said paint roller, at least one of said seal means being laterally perforate to accommodate lateral solvent flow.

13. A plunger-type paint roller cleaning device including, in combination, an elongated container having a closed end and an open end; a cap removably secured to said open end; a plunger passing through one of said ends and having piston means for reciprocatingly operating within of an exteriorly supplied paint roller, having an interior tube and an applicator nap peripherally secured thereto, when the latter is temporarily placed within said container, the combination of said container and said cap including structure for constraining solvent flow, when external solvent is supplied said container, through said nap longitudinally and circularly therethrough, preparatory to paint-charged solvent exit from said container; and means for discharging said solvent from said container, and wherein the combination of said cap and said container is provided with seal means for accommodating the seating of said paint roller, and wherein said seal means has liquid passageway means accommodating solvent flow.

* * * * *